US006129245A

United States Patent [19]

Redman et al.

[11] Patent Number: 6,129,245

[45] Date of Patent: Oct. 10, 2000

[54] WASHING SYSTEM WITH AUXILIARY RESERVOIR

[75] Inventors: Dennis W. Redman, Acton; Emmanuel A. Hanna, Lakeview Terrace, both of Calif.

[73] Assignee: Bobrick Washroom Equipment, Inc., North Hollywood, Calif.

[21] Appl. No.: 09/102,858

[22] Filed: Jun. 23, 1998

Related U.S. Application Data

[63] Continuation-in-part of application No. 08/701,788, Aug. 26, 1996.

[51] Int. Cl.[7] ..... B65D 35/36; B67D 5/52

[52] U.S. Cl. ..... 222/105; 222/136; 222/145.1; 222/255

[58] Field of Search ..... 222/105, 135, 222/136, 255, 145.1

[56] References Cited

U.S. PATENT DOCUMENTS

| | | | |
|---|---|---|---|
| D. 349,649 | 8/1994 | Hanna . | |
| 2,238,449 | 4/1941 | Peters . | |
| 2,515,328 | 7/1950 | Bobrick . | |
| 3,035,737 | 5/1962 | Speas . | |
| 3,319,835 | 5/1967 | Ensign et al. . | |
| 4,120,619 | 10/1978 | Blackband . | |
| 4,356,937 | 11/1982 | Simon et al. | 222/136 |
| 4,484,697 | 11/1984 | Fry . | |
| 4,515,294 | 5/1985 | Udall . | |
| 4,830,232 | 5/1989 | Greenberg et al. . | |
| 4,946,072 | 8/1990 | Albert et al. . | |
| 4,949,877 | 8/1990 | Hanna et al. . | |
| 4,964,544 | 10/1990 | Hanna et al. . | |
| 5,114,048 | 5/1992 | Minke . | |
| 5,163,587 | 11/1992 | Apps et al. | 222/105 |
| 5,299,713 | 4/1994 | Saitoh . | |
| 5,366,117 | 11/1994 | Mesenbring et al. . | |
| 5,476,197 | 12/1995 | Lawrence et al. . | |

FOREIGN PATENT DOCUMENTS

| | | |
|---|---|---|
| 0620328 | 10/1994 | European Pat. Off. . |
| 0781588 | 7/1997 | European Pat. Off. . |
| 2339382 | 8/1977 | France . |

OTHER PUBLICATIONS

Bobrick Washroom Equipment, Inc. Catallog, Toilet and Bath Accessories, Jan. 1993, title page and p. 15.

Bobrick Washroom Equipment, Inc. Catalog, Gravity Soap System, 1964, p. 10.

*Primary Examiner*—Kevin Shaver
*Assistant Examiner*—David Deal
*Attorney, Agent, or Firm*—Pretty, Schroeder & Poplawski, P.C.

[57] ABSTRACT

A washing system for dispensing a liquid cleanser from a collapsible container, with a plurality of dispensers, each dispenser having a positive displacement pump, a mount for mounting the pump on a dispenser support, and a connection for connecting the pump to a flexible supply line, a container support for supporting a collapsible container of liquid cleanser, and a flexible supply line for connecting the collapsible container to each of the pumps, with a one-way valve in the line for blocking fluid flow to the collapsible container while permitting fluid flow from the collapsible container to the dispensers. A secondary reservoir may be provided to permit continued service when the main reservoir is empty or is being replaced.

1 Claim, 9 Drawing Sheets

WASHING SYSTEM WITH AUXILIARY RESERVOIR

This application is a continuation-in-part of copending application Ser. No. 08/701,788 entitled Washing System filed Aug. 26, 1996.

FIELD OF THE INVENTION

This invention relates to washing systems for dispensing liquid cleaners, typically liquid or cream soaps.

BACKGROUND OF THE INVENTION

Washing systems for dispensing soap and/or lotion provide convenience for the users of public and semi-public facilities. In addition to convenience, these systems allow individual users to dispense an appropriate amount of liquid to address their needs, thereby reducing waste and further eliminating sanitary concerns that might be introduced with publicly shared supplies, such as, for example, bar soap.

A typical washing system includes a container for the soap and a manually operated valve which may be an off-on valve or a pump valve. Ordinarily the container is mounted directly on the valve structure. A variety of such dispensers are in common use today.

When there are multiple wash basins, a dispenser may be provided with every wash basin. Soap and/or lotion is provided to the dispensers in a variety of manners. For instance, in some systems, each individual dispenser has its own supply container. Dispensing systems utilizing an independent reservoir per dispenser, however, have increased unit costs and maintenance costs.

In another type of washing system, a plurality of the dispensers are served from a single container. In one such system, sometimes referred to as a gravity soap system, a liquid reservoir is mounted on the wall above a plurality of basins, with a dispenser positioned at each basin and fed by a line from the reservoir. The head pressure of the liquid in the container above the dispensers causes fluid to flow by gravity into each of the dispensers to fill the valve cavity. Liquid is dispensed by actuating the open-shut valve to empty the valve cavity into the operator's hand. When the valve is closed, the cavity is refilled by gravity flow from the reservoir. While this system works adequately when the reservoir is positioned directly above the dispensers, it is not satisfactory when the reservoir is positioned at a distance from the dispenser or below the dispenser or at the same level as the dispenser, as liquid will not flow from the reservoir to the dispenser. Also, of course, it requires that the reservoir be significantly above the dispensers in order to produce the necessary head pressure.

In another configuration, sometimes referred to as an under-the-counter system, the reservoir is positioned directly under the counter. In these systems the supply container is coupled to a single line or multiple lines that feed the individual pump type dispensers mounted above the counter. With this type of construction, the reservoir is filled by removing one of the dispensers and pouring the liquid through the dispenser housing into the reservoir below the counter. After the refill operation, each of the pump dispensers must be primed by repeatedly actuating the pump mechanism. Typically about 75 to 110 strokes are required per dispenser to adequately prime the dispenser to start pumping.

Existing multiple valve, single reservoir systems have several disadvantages. The valves are high cost, designed to withstand a high hydraulic head. The piping system is made of costly metallic pipes either inside the wall, requiring early plumbing, or exposed non-esthetically pleasing plumbing. The soap used has to be a water thin vegetable soap, to run in the pipes and meet the valve design criteria. Such soap, once popular, is now outdated and currently replaced with lotion type soap, which is much more difficult to draw through the pipes. In addition, these systems empty the supply line when the reservoir is empty. Thus, the lines must be reprimed. If the lines are long, more effort is required to reprime them.

A problem encountered by all of the above mentioned current feed systems is that they fail to provide the dispensing liquid in an ongoing manner; namely, they fail to provide a continuous and uninterrupted supply of dispensing liquid for the users. Indeed, in situations wherein the dispensers are refilled after they are empty, an interim period exists where some users will not be provided with the dispensing liquid. Of course, the supply reservoir can be replenished prior to becoming entirely empty, but this results in increased maintenance costs and in instances where the supply reservoirs are sealed containers, the remaining dispensing liquid is wasted.

Although current systems attempt to provide an ample supply of dispensing liquid, none of the current systems address the issue of providing an economical and continuous, uninterrupted supply of dispensing liquid. Further, the current systems have increased maintenance costs and inconvenience to the end users. As such, a need exists in the industry for a feed system that is capable of providing a relatively uninterrupted supply of dispensing liquid to the users. Further, a need exists for a system that does not require repriming of the dispensers if the supply is interrupted once the supply of dispensing liquid is replaced. A need further exists for a feed system that is capable of dispensing the lotion type soaps that are common today over long distances.

SUMMARY OF THE INVENTION

The washing system of the present invention is designed for use with a sealed, large capacity cleanser reservoir in the form of a flexible or collapsible container which can be located at any height and in any area. The reservoir provides the cleanser to a plurality of individual dispensers, which may be attached directly to a wall or other support, with the dispenser pump itself within a housing for improved vandal resistance. Inexpensive flexible tubing serves to connect the cleanser container to the individual dispensers which can utilize multi-viscosity, low cost, bulk liquid soap from containers which can provide a month's supply. Actuation of the pump at the dispenser deposits the liquid directly into the user's hand. The amount of cleanser in the reservoir can be periodically checked and the reservoir replaced when the content falls to a predetermined level, or the reservoir can be replaced periodically on a scheduled maintenance event. Alternatively, one can wait until the reservoir is empty and then install a new reservoir without requiring re-priming.

Preferred embodiments of the invention includes a washing system for dispensing a liquid cleanser from a collapsible container, with a plurality of dispensers, each dispenser having a positive displacement pump, mounting means for mounting the pump on a dispenser support, and connection means for connecting the pump to a flexible supply line, a container support for supporting a collapsible container of liquid cleanser, and a flexible supply line for connecting the collapsible container to each of the pumps, with a one-way valve in the line for blocking fluid flow to the collapsible container while permitting fluid flow from the collapsible container to the dispensers.

One embodiment of the washing system includes a cabinet with the container support positioned in the cabinet, with an access door for removing a used collapsible container and placing a new container in the container support, and a lock for securing the access door on the cabinet. In an alternative embodiment the container may be placed in a remote room.

In another preferred embodiment, the dispensers are mounted on a wall and the supply line is behind the wall. The dispensers may be mounted on a wall above a counter, with the container support means below the counter, and with the supply line behind the wall between the dispensers and the container support means. Alternatively the dispensers may be mounted on a wall in a first room, with the container support means in a second room, and with the supply line behind the wall between the dispensers and a cabinet support means in the second room. In another alternative embodiment, the dispenser may be mounted on a counter, with the container under the counter.

Each of the dispensers preferably includes a tubular casing with an inlet tube as the connection means for slidingly receiving an end of the flexible supply line and with the positive displacement pump slidably inserted into the casing, with the positive displacement pump having a cylinder with a piston cavity and a piston sliding in the cavity, means defining an inlet opening in the cylinder for fluid flow from the flexible supply line through the inlet tube into the piston cavity, a spring in the piston cavity for urging the piston outward, a one-way valve positioned between the inlet opening of the cylinder and spring, another one-way valve positioned between the spring and piston, with the piston having an outlet flow passage defining a flow path from the flexible supply line through the casing inlet tube, cylinder and piston cavity to the exterior of the dispenser.

Each of the dispenser pumps may further include a first retainer means for fixing the cylinder in the casing, first sliding seal means between the cylinder and casing for blocking fluid flow from the casing around the cylinder, second sliding seal means between the piston and the interior of the cylinder for blocking fluid flow from the cylinder around the piston, and second retainer means for retaining the piston in the cylinder while permitting reciprocation of the new piston in the cylinder during fluid dispensing.

In an alternative embodiment, the washing system includes a first reservoir, a second reservoir and a fitting, wherein the fitting couples, in fluid communication, the first reservoir to the second reservoir, and further couples, in fluid communication, the first and second reservoirs to a dispenser. Preferably, the reservoirs are positioned such that the larger reservoir is placed above the smaller reservoir. An advantage of this feature is that the dispensing liquid will fall by gravity into the lower reservoir such that the dispensing liquid in the lower reservoir is not diminished, thereby eliminating the need to replace or refill the lower reservoir.

Preferably, the first and/or the second reservoir is controlled with a one-way valve, piston type valve or other valve that automatically caps off the supply line when the reservoir is disconnected from the rest of the system. An advantage of this feature is that the supply line remains filled with lotion, thereby eliminating the problem of repriming the system whenever the dispensing liquid is replaced. Thus, the system provides continuous service and immediate use without the need of repriming.

Another feature of the invention is the use of noncollapsible flexible tubing. An advantage of this feature is that the reservoirs can be placed in substantially any location without being limited by the placement of the tubing. A further advantage is that the noncollapsible tubing prevents the dispensing liquid from being completely drawn out of the tubing when the reservoirs are empty, thereby, further eliminating the problem of repriming.

The reservoirs of the instant invention can be of varying volumetric sizes. This feature allows the system to accommodate a multitude of space configurations.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

BRIEF DESCRIPTION OF THE DRAWINGS

The detailed description of preferred embodiments of the invention will be made with reference to the accompanying drawings, wherein like numerals designate corresponding parts in the figures.

DETAILED DESCRIPTION OF PREFERRED EMBODIMENTS

Figure 1:
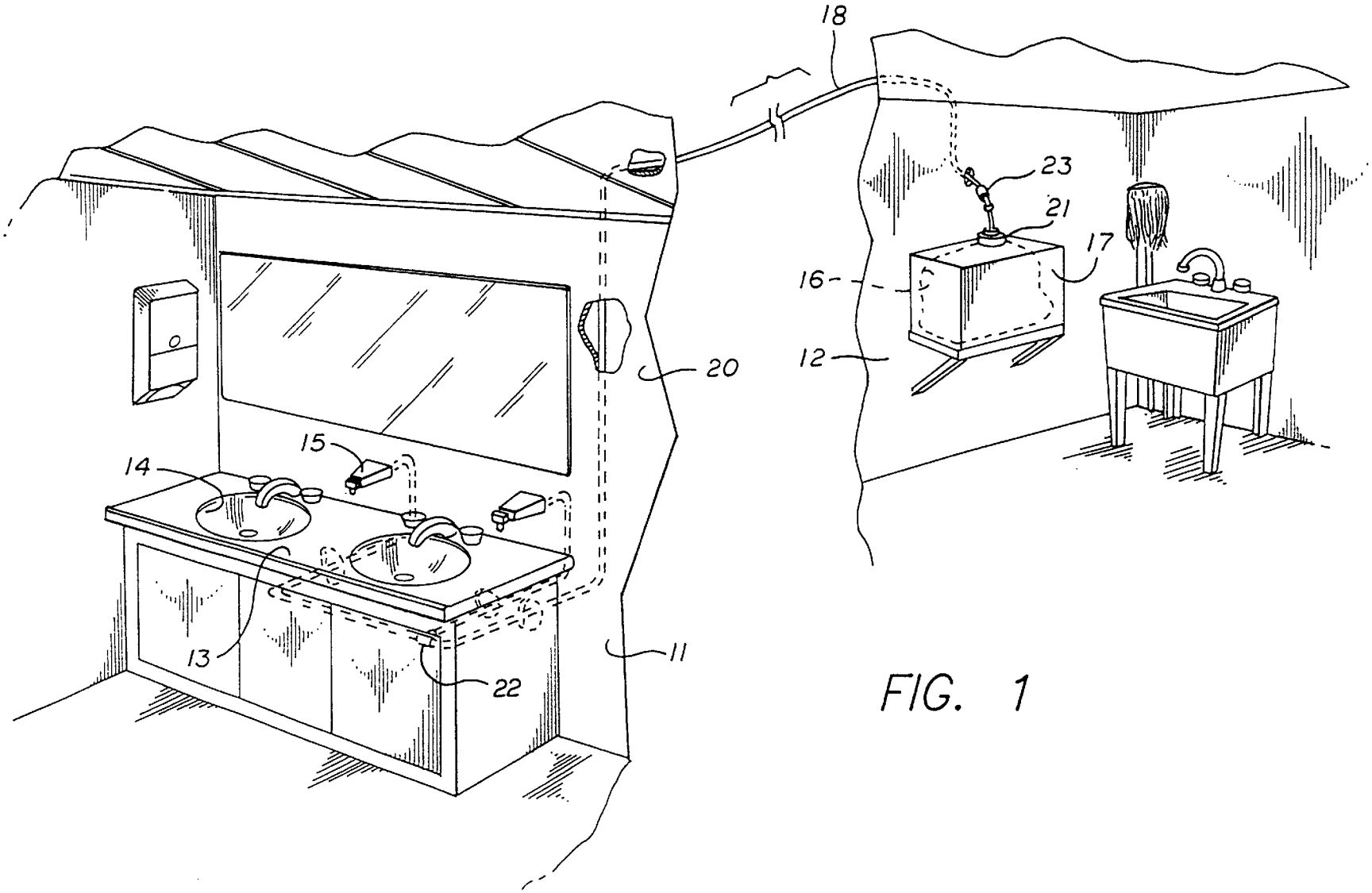
FIG. 1 is a perspective view illustrating the washing system of the invention with the liquid cleanser container mounted in a room separate from the wash basins and cleanser dispensers.

One embodiment of the washing system of the invention is illustrated in FIG. 1 installed in a washing room 11 and a service room 12. The washing room includes a conventional counter 13 with basins 14 and dispensers 15. A collapsible soap container 16 is positioned in a support box 17 in the service room 12, and is connected to the dispensers 15 via a flexible line 18, typically plastic tubing. The line 18 has an airtight cap or other connection 21 for connection to the container 16, and feeds liquid to each of the dispensers 15 through one or more tee fittings 22.

In the embodiment illustrated, the dispensers are mounted on the wall 20 of the washing room 11 in position above and adjacent basins 14. The line is positioned behind the wall 20 and is connected to the dispenser 15, as is shown in greater detail in FIG. 3. The line runs up the wall and above the hung ceiling of the washing room and onward to the service room 12 for connection to the liquid container. While two dispensers are illustrated, the washing system can be used with one dispenser and with more than two if desired.

Figure 2:
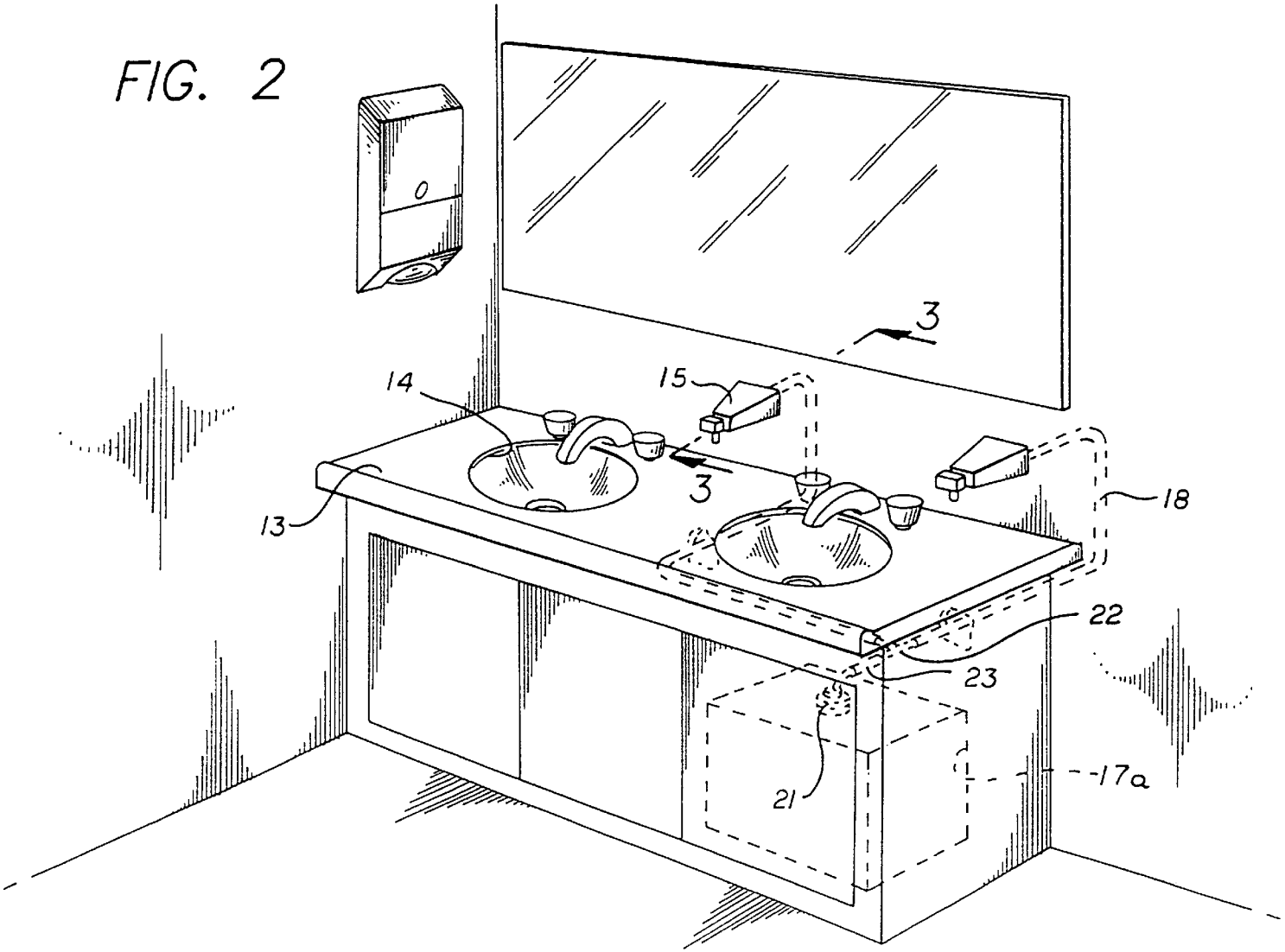
FIG. 2 is a view similar to that of FIG. 1 with the liquid cleanser container mounted underneath the counter.

An alternative configuration of the washing system is shown in FIG. 2, with the support box 17*a* for the container positioned below the counter 13. In each embodiment, the support box 17 may rest on a shelf, or in a cabinet, with or without a locked door, or on another article, or otherwise as desired.

Figure 4:
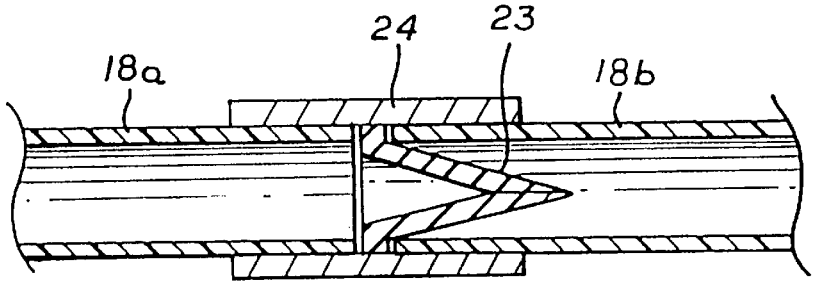
FIG. 4 is an enlarged sectional view of one configuration for installing the one-way valve in the supply line.
Figure 6:
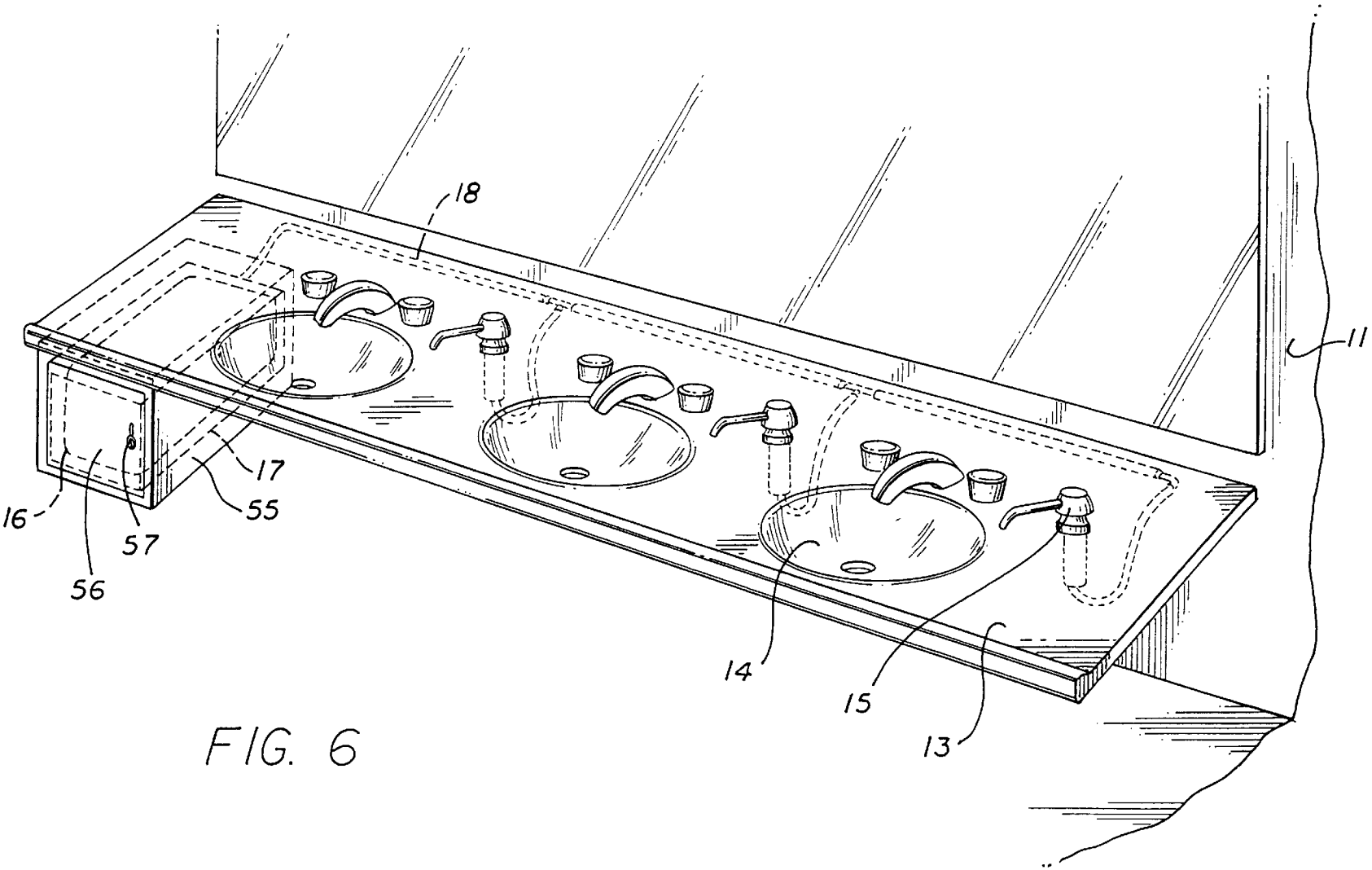
FIG. 6 is a view similar to those of FIGS. 1 and 2 with the dispensers mounted on the counter adjacent the basin, with the cleanser container mounted underneath the counter.

In each embodiment, a one-way valve 23 is positioned in the line 18 at a location between the fluid container 16 and the dispensers 15. The purpose of the one-way valve is to block fluid flow through the line from the dispensers to the collapsible container, while permitting fluid flow from the collapsible container to the dispensers. One specific installation for the one-way valve 23 is illustrated in FIG. 4. The line is formed in two sections 18*a,* 18*b* with the one-way valve 23 positioned between the two sections. In this installation the one-way valve is a flapper or duck type valve which permits fluid flow to the right as viewed in FIG. 4 while blocking fluid flow to the left. A sleeve 24 is positioned around the ends with the valve therebetween and may be clamped or cemented or otherwise held in place as desired.

Figure 5:
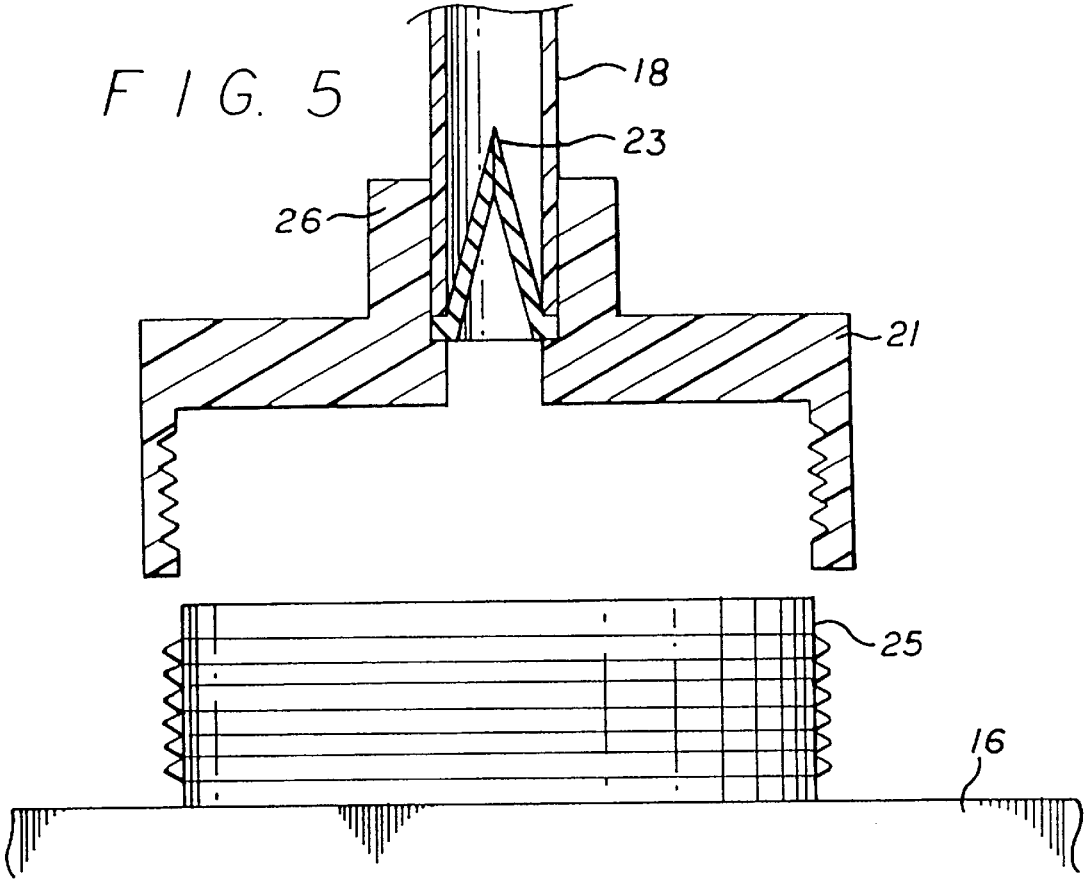
FIG. 5 is a view similar to that of FIG. 4 showing an alternate configuration for installing the one-way valve.

An alternative construction for positioning the one-way valve is illustrated in FIG. 5. The container 16 has a top or outlet 25 and the cap 21 fits over the top 25 as by screwing or by snapping or otherwise as desired. The one-way valve 23 is positioned in a section 26 of the cap, with the upstream end of the line 18 pushed into the section 26. The line may be clamped or cemented or otherwise held in place as desired. Since the supply line is a low pressure system, high pressure seals are not indicated.

Each dispenser includes a positive displacement pump which may be manually operable or electrically powered, as desired. The presently preferred embodiment of the dispenser is illustrated in detail in FIG. 3.; however, other configurations for the dispenser and positive displacement pump may be used. The dispenser includes a tubular casing 29 with an inlet tube 30 for connection to the line 18. The casing is mounted on the wall 23 with the tube 30 positioned in an opening 31 in the wall. The end of the line 18 may be fastened on the inlet tube 30 by a fastener 32. The casing 29 may be mounted on the wall 23 by toggle bolts or screws or other fasteners 33 positioned in aligned openings 34 in the casing and aligned openings 35 in the wall. The openings 34 are parallel with each other and perpendicular to the wall.

The positive displacement pump includes a cylinder 38 with a piston 39 sliding in a piston cavity 40 of the cylinder. A spring 41 is positioned in the cylinder cavity between a washer 42 and a one-way valve 43 at one end and another washer 45 and one-way valve 44 at the other end. The one-way valve may be conventional in design, such as a duckbill valve or a capsule valve with head holding capacity. A seal ring 46 is positioned on the cylinder for sealing engagement with the interior wall of the casing 29. Another seal ring 47 is provided in the piston for sealing engagement with the interior wall of the cylinder. A fastener, such as a screw 48, provides for connecting the pump to the casing. A pin 49 is fixed in the cylinder 38 and rides in a slot 50 in the piston, permitting sliding of the piston in the cylinder while limiting the piston travel and preventing piston rotation, thereby keeping the soap outlet downwards.

Figure 3:
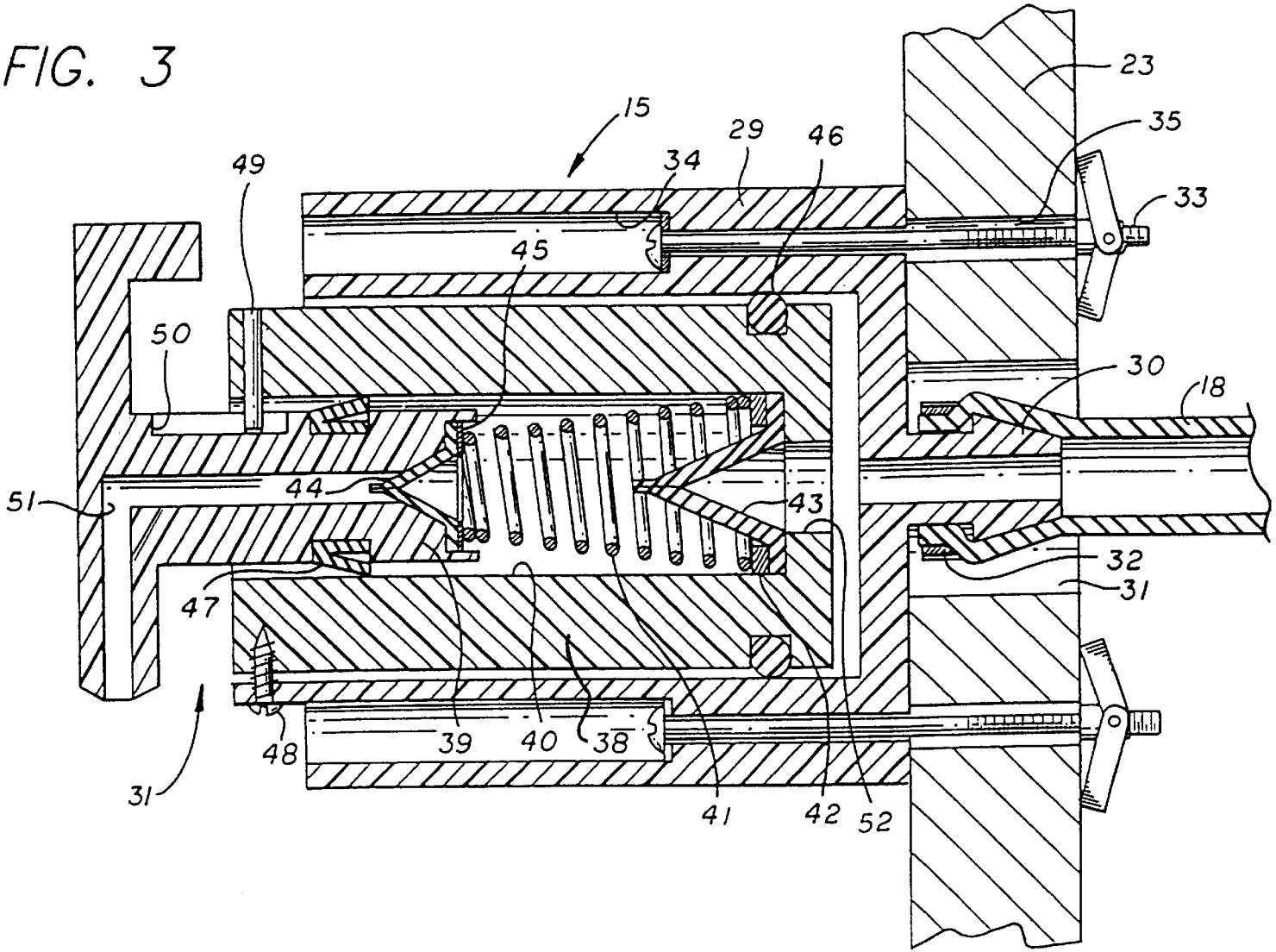
FIG. 3 is an enlarged sectional view of a dispenser taken along the line 3—3 of FIG. 2.

In operation, moving the piston inward or to the right as viewed in FIG. 3, forces fluid from the interior of the cylinder out through the valve 44 and the passage 51 of the piston into the user's hand. When the inward pressure on the piston is released, the spring moves the piston outward, to the left as viewed in FIG. 3, which motion draws fluid from the line 18 through the inlet tube 30 and opening 52 in the cylinder through the valve 43 into the interior of the pump, regardless of the position of the container with respect to the dispenser.

Since the dispenser does not operate with gravity flow, a construction for preventing leakage at high pressure heads is not required. The dispenser as disclosed has a low cost simple construction. The cylinder and piston may be plastic molded parts and the entire pump requires only two one-way valves, the spring, the retaining screw and pin, and the sliding seals. The casing itself should be a high strength casting to reduce damage due to vandalism, while this construction makes the pump easily replaced.

The casting typically may be chrome plated die cast zinc for both durability and strength. Alternatively, plated strong plastic material may be used for the casing. The positive displacement pump may be a liquid pump or a lather pump as desired.

The line is typically a flexible plastic tubing which can be readily installed after the walls of the rooms are constructed.

The one-way valve in the line adjacent the supply container also prevents soap dripping from the line or leaking out during changing of the soap container.

In the embodiment shown in FIGS. 6–9, components corresponding to those of the earlier figures are identified by the same reference numbers. In this embodiment, the dispensers 15 are mounted on the counter 13, and a cabinet 55 is mounted underneath the counter for receiving the liquid cleanser container 16 and the support box 17. Preferably, the cabinet has a hinged door 56 with a locking latch 57 for controlling access to the cabinet.

Figure 7:
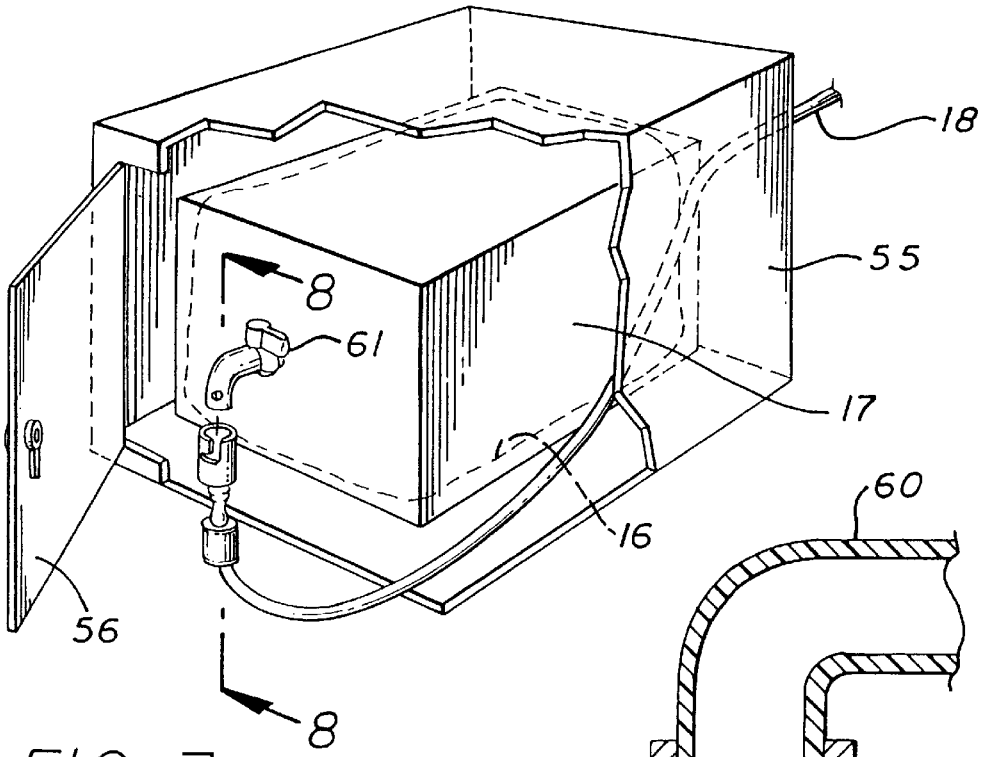
FIG. 7 is an enlarged view of a portion of FIG. 6 showing the installation of the cleanser container and support box in the cabinet.
Figure 8:
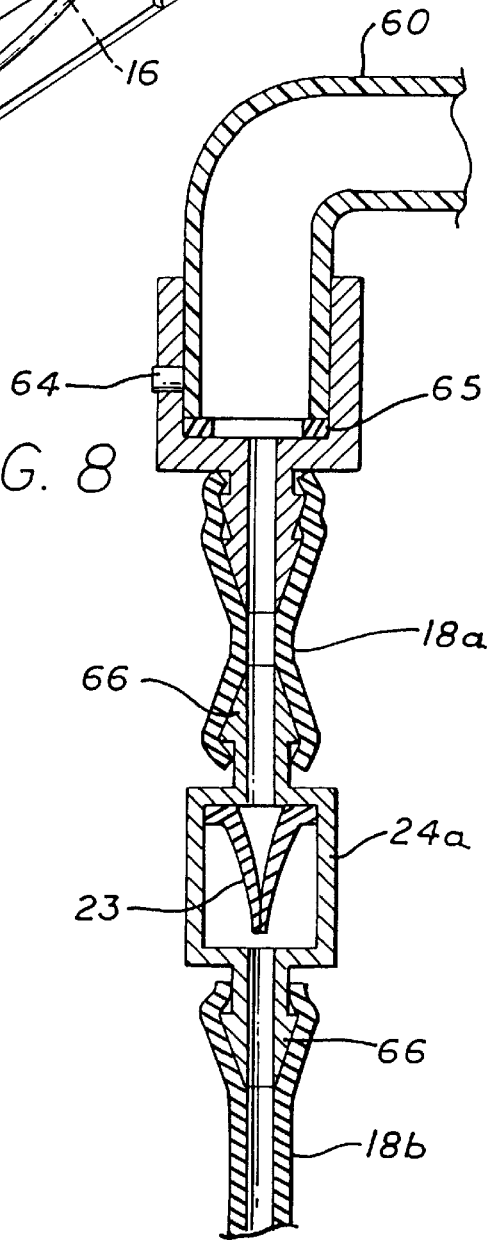
FIG. 8 is an enlarged partial sectional view taken along the line 8—8 of FIG. 7.
Figure 9:
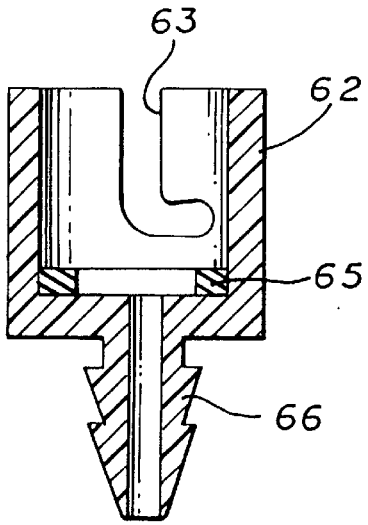
FIG. 9 is an enlarged sectional view of the connector of FIGS. 7 and 8.

In this embodiment as illustrated in FIGS. 7–9, an outlet nozzle 60 is carried in the support box 17 for connection to the container 16. A lever control valve 61 may be affixed in the nozzle for controlling flow.

The flexible line 18 is connected to the nozzle 60 by a coupling 62 with a J-shaped slot 63 for engaging a pin 64 at the outer end of the nozzle 60. Typically a gasket 65 is positioned in the coupling 62 for sealing engagement with the end of the nozzle 60.

A one-way valve 23 may be positioned in the line 18 in a fitting 24*a,* with this fitting connected between portions 18*a* and 18*b* of the line by conventional barbed projections 66.

Figure 10:
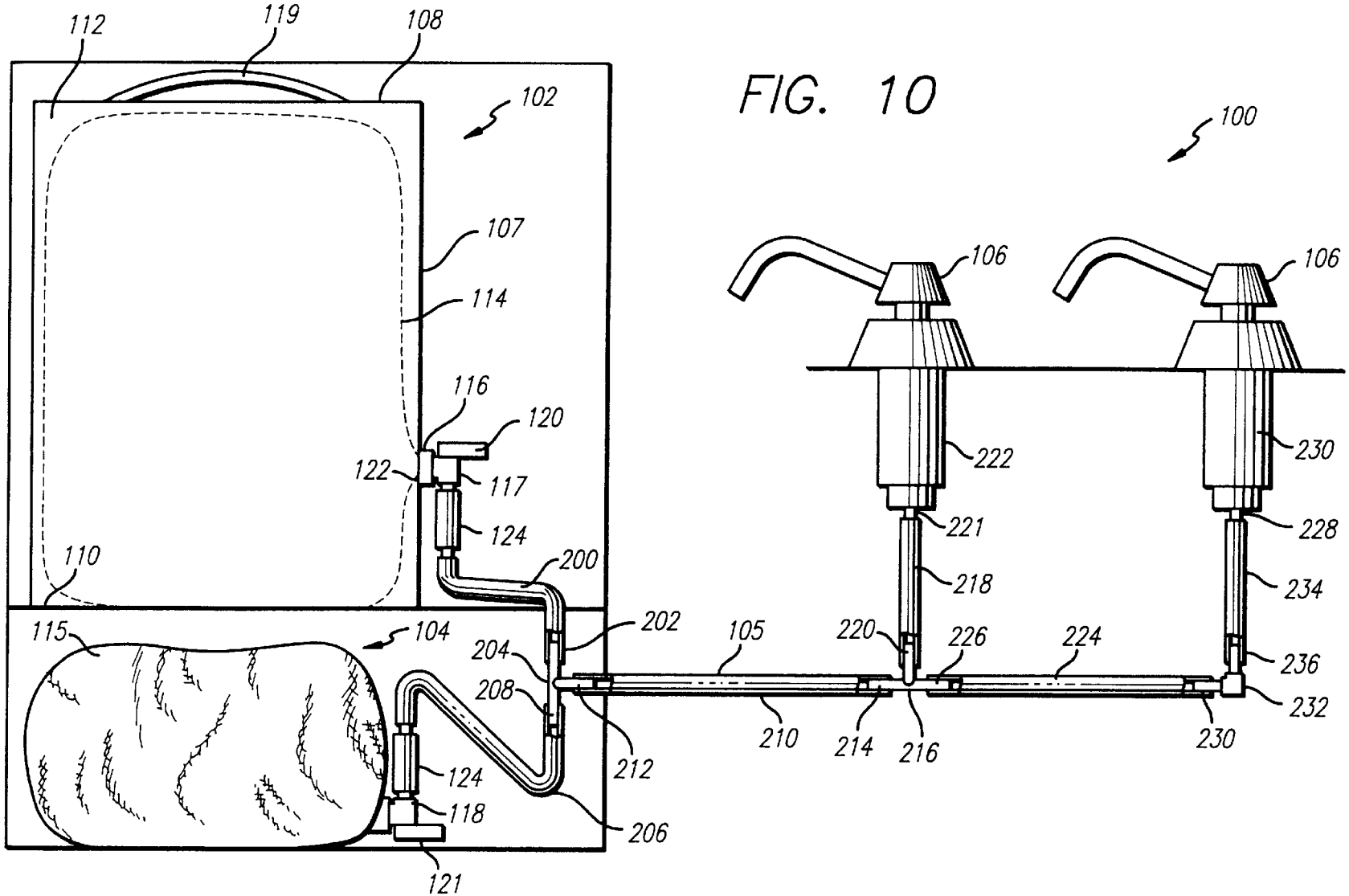
FIG. 10 is a schematic of a washing system with auxiliary reservoir of the invention.

With reference to FIG. 10, an alternative embodiment of a washing system 100 of the present invention is shown. The washing system 100 includes a main reservoir 102, a secondary or auxiliary reservoir 104, a connecting line 105 and two dispensers 106. While any dispenser may be utilized, the presently preferred dispenser design is that shown in U.S. Pat. No. 5,476,197, which is incorporated by reference herein.

The main reservoir includes a carton 107 having a top end 108, a bottom end 110 and a hollow interior 112. A collapsible soap container 114 is disposed within the carton. The carton includes an outlet 116 through which an outlet nozzle 117 of the soap container may pass. Preferably, the outlet nozzle is mounted in the outlet of the carton by conventional means, which permit the nozzle to rotate to achieve any desired orientation, e.g., vertically or horizontally.

The carton 107 may be made from heavy cardboard, or any other material suitable for supporting therein a full soap container. In one preferred embodiment, the main body is rectangular, although any shape which facilitates stable storage is suitable. In some preferred embodiments, the carton further includes a handle 119 which is disposed on the top end 108 of the carton and a detachable box-end (not shown) for protection of the nozzle 117.

Preferably, the collapsible soap container 114 is made from heavy plastics, although any nonpermeable material is suitable. In addition the container may be made from "bacteria resistant" or antibacterial material such that microbes, spores or other germs or bacteria do not cultivate within the dispensing liquid.

The collapsible soap container 114 includes the outlet nozzle 117, and a lever control valve 120 such as an on/off valve, which is well known in the art. The valve controls the flow of the dispensing liquid from the container through the nozzle. The outlet nozzle is coupled to an outlet 122 of the soap container, e.g., by welding, and is made from sturdy material, such as, but not limited to heavy plastics or metal, although any material capable of facilitating the flow of liquids such as lotion type soap or other similar liquids more viscous than water is suitable.

The secondary reservoir 104 also includes a collapsible soap container 115, having an outlet nozzle 118. The container and nozzle may be of the same type as used in the main reservoir 102. The soap container of the secondary reservoir need not be encased in a carton since it is replaced less often than the main reservoir.

The soap containers 114, 115 can be made to accommodate any volumetric size. In one preferred embodiment, the soap container of the main reservoir 102 is capable of storing about 12 liters of dispensing liquid, and the soap container of the secondary reservoir 104 is smaller and capable of storing about 3 liters of dispensing liquid. The volumetric size of the reservoirs is limited, in part, only by practical considerations, such as, for example, storage size and weight of the reservoir with the liquid. However, any varying sizes conducive to conveniently supplying dispensing liquid to end users is suitable.

Preferably, at least two reservoirs 102, 104 of varying sizes are utilized together, wherein the main reservoir 102 is disposed above the secondary reservoir 104 such that gravity acts on the dispensing liquid in the main reservoir to pull the dispensing liquid downward, into the secondary reservoir. The reservoirs may be placed on shelving or any other type of storage unit that protects the reservoirs from being disturbed or falling over. Typically, the secondary reservoir 104 is placed between two shelves such that it is protected and the main reservoir 102 resides on the shelf above the secondary reservoir. The use of both reservoirs allows the main reservoir to be replaced when empty without affecting the supply of dispensing liquid to the end users as the secondary reservoir continues supplying liquid to the users. Preferably, a valve 121 of the secondary reservoir, if provided, remains in the open position at all times, as the secondary reservoir need not be changed.

Figure 11:
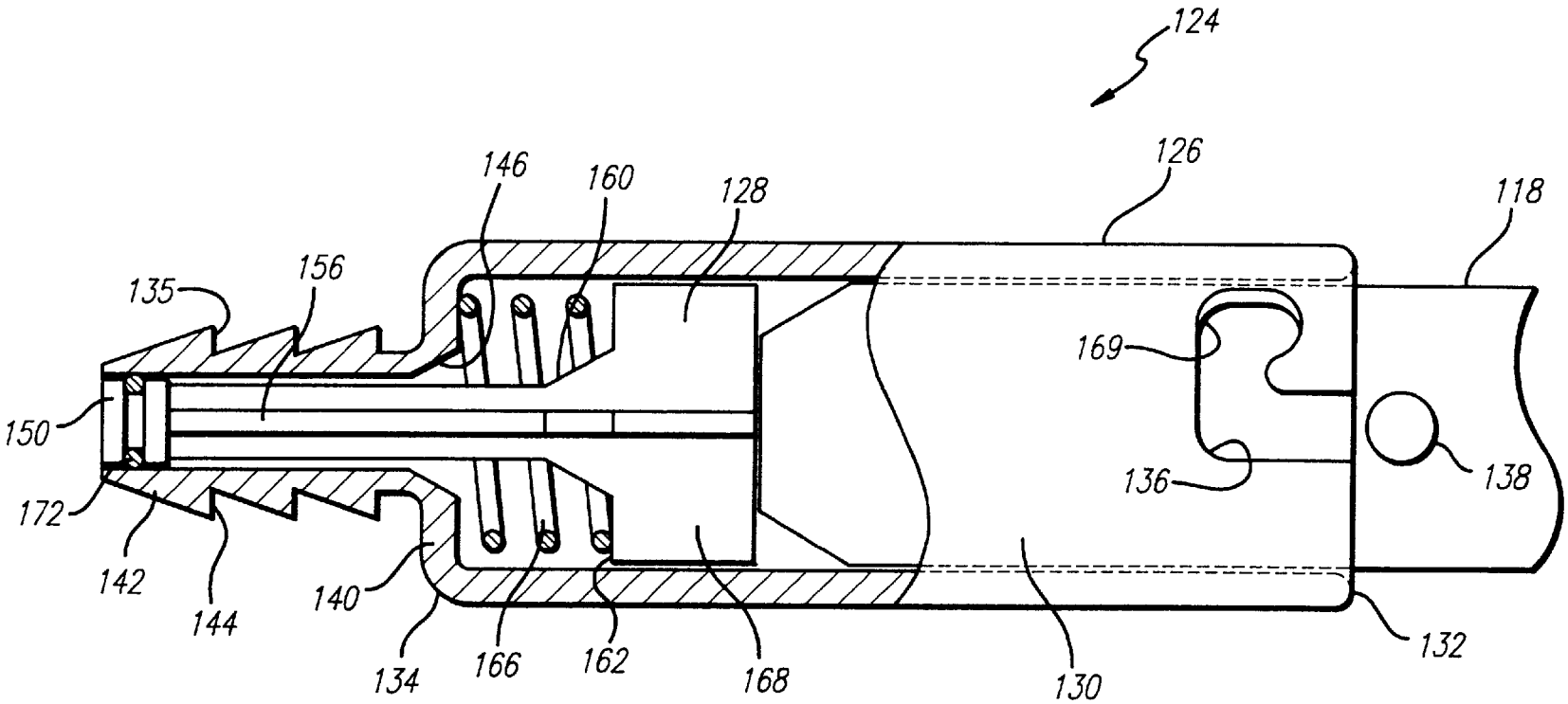
FIG. 11 is a front view, partially in section, of a piston-type adapter of the present invention.

An adapter 124 is preferably mounted to the outlet nozzles 117, 118 of the collapsible soap containers 114, 115 of the main and secondary reservoirs. With reference also to FIG. 11, the adapter 124 includes a housing 126, and a piston 128. The housing 126 has a substantially cylindrical portion 130 having a first end 132 and a second end 134 and a barbed outlet 135. The first end of the upper portion is open and is sized to receive the outlet nozzle 117 of the soap container 114 on the outlet nozzle 118 of the soap container 115. The first end further includes a J-shaped channel 136 that is configured to receive a pin 138 on the outlet nozzles to form a bayonet-type connection such that the adapter 124 and the outlet nozzle can be coupled together. The second end 134 of the cylindrical portion forms an annular wall 140.

The barbed outlet 135 extends from the second end 134 of the cylindrical portion of the housing and includes a hollow body 142 having an outer barbed surface 144. The interior of the barbed outlet includes a flared opening 146 that widens toward the interior of the cylindrical portion. Preferably, the cylindrical portion and the barbed outlet of the housing are manufactured as a unitary piece. The outer barbed surface 144 facilitates coupling to a plastic tube. Other surface configurations, or other means capable of securing a tube to the adapter 124, such as a clamp, however, are also suitable.

Figure 12:
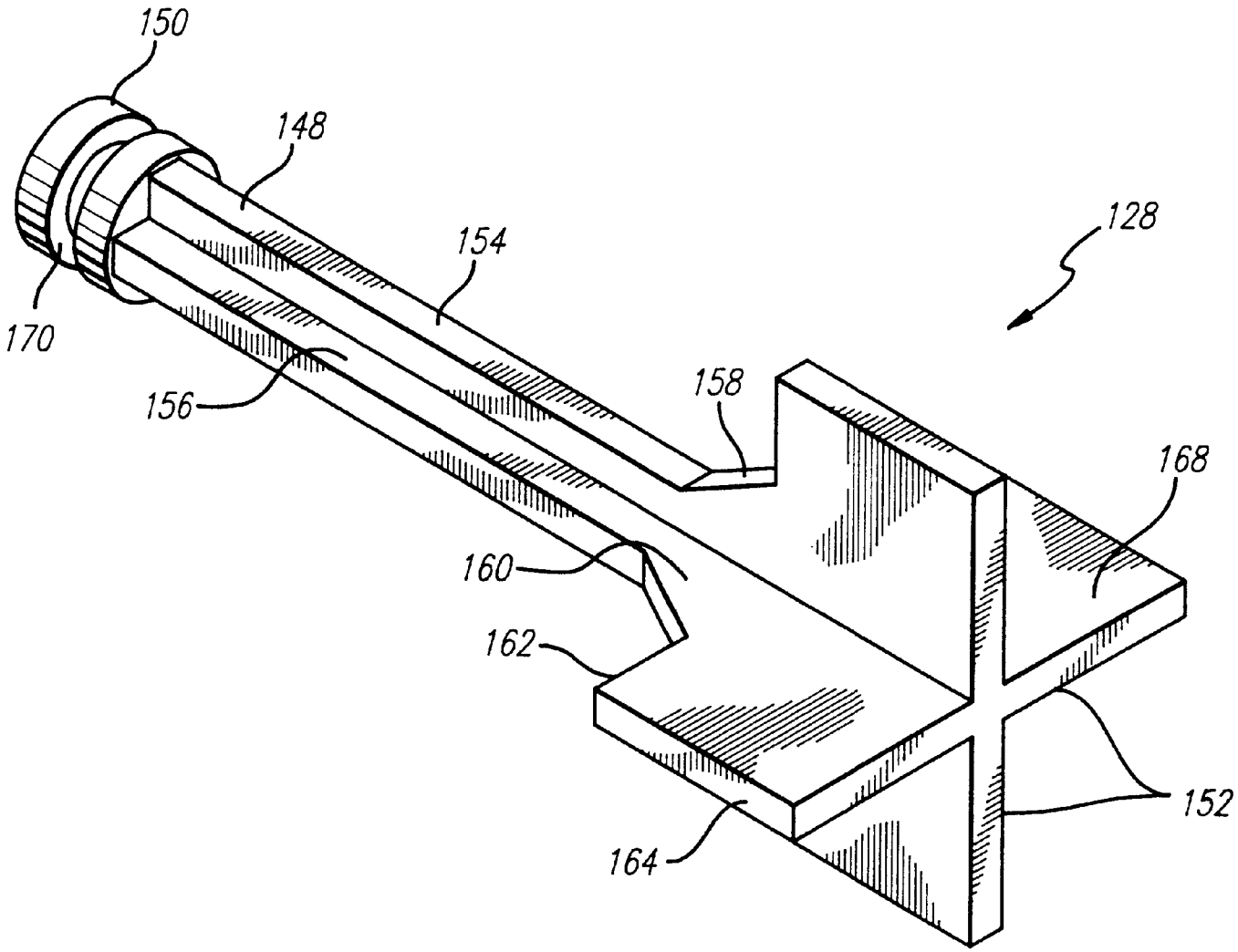
FIG. 12 is a perspective view of the piston of FIG. 11.

With reference also to FIG. 12, the piston 128 includes a shaft 148 having a plug 150 mounted at one end thereof. The shaft preferably includes four ribs 152 that come together at their inner ends to form a cross-shape. Each rib has a first end portion 154 that extends longitudinally from the plug 150 and has a width slightly smaller than the radius of the bore of the barbed outlet 135 such that the first end portions of the four ribs form a cross shaped first end portion 156 that fits within the bore of the barbed outlet and provides flow passages between the ribs through the barbed outlet.

Each rib 152 also has a tapered portion 158 that flares out from the first end portion 154.

The four tapered portions form a cross shaped tapered portion 160 that mates with the flared opening 146 by the barbed outlet.

Each rib 152 further has a radially extending shoulder portion 162 and a second end portion 164. A spring 166 is located between and engages the shoulder portions 162 of the ribs and the annular wall 140 of the housing to bias the piston 128 towards the first end 132 of the cylindrical portion of the housing.

The second end portions 164 of the four ribs 152 forms a cross shaped second end portion 168 that closely fits within the cylindrically upper portion 130 of the housing and provides flow passage between the ribs through the cylindrical portion.

The plug 150 is a disc shaped member that fits within the bore of the barbed outlet 135. A peripheral groove 170 in the plug receives a O-ring 172 to form a seal between the plug and the barbed outlet to prevent the liquid soap from leaking out of the adapter. Preferably, the shaft 148 and the plug 150 are manufactured as a single unitary piece.

The adapter 124 maybe mounted, for example, to the outlet nozzle 117 of the collapsible soap container 114 by placing it over the end of the outlet nozzle such that the pin 138 of the outlet nozzle enters the J-shaped channel 136 of the adapter 124. As the adapter is mounted to the outlet nozzle, the end of the outlet nozzle engages the cross-shaped second end portion 168 of the piston and slides it downward, disengaging the O-ring 172 from the bore of the barbed outlet 135, permitting liquid soap to flow through the adapter when the lever control valve 120 is opened. The adapter is secured to the outlet nozzle by rotating the adapter such that the pin 138 of the outlet nozzle is located in the circumferentially extending portion 169 of the J-shaped channel 136. Notably, when it is time to replace an empty soap container 114 with a full container, the adapter is disengaged from the outlet nozzle and the plug 150 of the piston automatically retracts into the bore of the outlet nozzle due to the biasing action of the spring 166. This prevents liquid from the dispenser and connecting line 105 from leaking back out through the adapter.

It is to be appreciated that in some embodiments, the secondary reservoir 104 need not utilize the adapter, but rather the outlet nozzle 118 may be modified such that it directly couples with the connecting line 105. As stated above, there is less of a need to be able to control fluid flow into the secondary reservoir as it is not changed as often as the first reservoir.

With reference again to FIG. 10, a first connecting tube 200 is coupled between the adapter 124 on the main reservoir 102 and a first inlet 202 of a first T-connector 204. A second connecting tube 206 is coupled between the adapter 124 on the secondary reservoir 104 and a second inlet 208 of the first T-connector. A third connecting tube 210 is coupled between an outlet 212 of the first T-connector and a first inlet 214 of a second T-connector 216. A fourth connecting tube 218 is coupled between a first outlet 221 of the second T-connector and an inlet 220 to a first dispenser 222. A fifth connecting tube 224 is coupled between a second outlet 226 of the second T-connector and an inlet 228 to a second dispenser 230. Alternatively, the outlet end of the fifth connecting tube 224 may be coupled to an inlet 230 of an elbow connector 232 and a sixth connecting tube 234 may be coupled between an outlet 236 of the elbow connector to the inlet of the second dispenser 230. Preferably, all the connecting tubes are made from a flexible material that does not collapse during use. It will also be appreciated that many different types of fittings, such as tees, elbows, cross fittings, etc. may be used depending on the application. In addition, reducers may be inserted in the lines to connect any size soap container to any size dispenser.

Once the reservoirs are located in a facility, e.g., a restroom, the adapters 124 are connected to the outlet nozzles 117, 118 on both reservoirs and the dispensers 106 are initially primed such that dispensing liquid fills the connecting tubes. When an end user operates the dispenser, fluid is drawn from the connecting tubes through the dispenser and into the end user's hands.

Typically, due to gravity, liquid from the main reservoir 102 moves downward into the secondary reservoir 104 such that the secondary reservoir remains full. The liquid is drawn from both reservoirs through the first T-connector 204 from tubes 200, 206. The dispensing liquid is drawn through the first T-connector and traverses the connecting tubes 210, 218, 224, 134 until it reaches the dispensers 106.

Since the collapsible soap containers 114, 115 are airtight, the containers collapse as the soap is withdrawn. When the containers are empty, the dispensers will stop delivering soap but the connecting tubes will remain full of liquid as they do not collapse and no air is displacing the liquid content. Therefore, the dispensing system will remain primed.

Typically, the main reservoir 102 will empty before the secondary reservoir 104. After the main reservoir is empty, maintenance personnel disconnect the adapter 124 from the outlet nozzle 117 on the main reservoir and remove the main reservoir from the location. As the adapter is removed, the piston 128 (FIG. 11) slides toward the first end 132 of the housing 126 such that the O-ring 172 retracts and seals the barbed outlet 135, and hereby preventing any back flow of the dispensing liquid out of the connecting tube 200 and adapter. Removal of the main reservoir does not affect operation of the washing system. Rather, the dispensers 106, when operated, begin drawing liquid from the secondary reservoir 104 until such time that the main reservoir has been replaced. Thus, the end user is unaware of the removal of the main reservoir. Finally, the main reservoir is replaced and the secondary reservoir is replenished from the main reservoir by gravity. The supplemental reservoir also allows continuation of service even if the main reservoir is empty and while it is being replaced.

If the demand for soap exceeds the capacity and both reservoirs become empty, the dispensers will stop delivering liquid but the connecting tubes will remain filled with liquid that cannot be dispensed. This is a feature that allows immediate dispensing from the dispensers as soon as the empty reservoirs are replaced, provided both reservoirs are connected to an adapter that seals the end of the connecting tube as each reservoir is replaced. After replacement, the newly supplied liquid simply allows the liquid already in the tubes to be dispensed first.

It should be appreciated that a one-way valve such as that shown in FIGS. 4 and 5 may be substituted for the adapter 124 in the main reservoir and still achieve the benefit of the invention discussed above. Preferably, however, a one-way valve is not used with the secondary reservoir since it is desired that the secondary reservoir receive fluid from the main reservoir when it is not full. Thus, typically, the secondary reservoir is used with only an on/off valve and/or the adapter 124 described above or, in some instances, without either a valve or an adapter.

The construction of the invention readily permits the use of the large capacity containers now available, including the twelve and twenty-four liter containers now used for soap supplies. In operation, the flexible container collapses as the soap is withdrawn, since the container is airtight. When the container is empty, the pumps will stop delivering soap but the supply lines will remain full of liquid as they do not collapse and no air is displacing the liquid content. Therefore, the dispensing system will remain pre-primed.

The container exchange is a time saving feature for maintenance; no bulk soap is poured or spilled and only one container is required to fill multiple dispensers. This system is very hygienic with no outside contamination problem. The system is essentially vandal proof having no vessels to tamper with. This system is a low-cost installation and maintenance system; expensive stainless steel vessels are not needed. The washing system is especially suitable for use in fast food restaurants and other installations with high public traffic where frequent interruptions for servicing the equipment is undesirable.

Advantages of the new washing system include the following. It delivers soap thru soap pumps which can be mounted directly to the wall or counter, without costly soap vessels attached to them. It handles a wide range of soap viscosity from water thin to shampoo like thickness. The system has a centrally located soap reservoir for supply to all the soap pumps. A single fill of the reservoir will refill the complete washroom. The soap reservoir can be mounted on the floor level or under counter or in a remote area. The soap pumps may be connected to the reservoir via plastic tubing running behind the wall, above a hung ceiling, to a maintenance or service room, normally 25 to 50 feet away, to the soap reservoir. This soap reservoir will usually be in the same room containing the cleaning supply. The soap pumps will stop delivering once the soap reservoir is empty, but the supply plastic tubes will remain filled with liquid at all times for quick priming. The long supply line will have a one-way valve on its end by the soap reservoir. This valve will prevent the tube from draining during soap refilling. The soap reservoir is a sealed large plastic collapsible container. The first time priming of the system will be done by providing the long supply line pre-filled soap in the factory, and plugged at both ends. No re-priming is required in between refills.

Although the foregoing describes the invention with preferred embodiments, this is not intended to limit the invention. Rather, the foregoing is intended to cover all modifications and alternative constructions falling within the spirit and scope of the invention.

We claim:

1. A washing system comprising:

a plurality of dispensers, each dispenser including a positive displacement pump having an inlet to the positive displacement pump and an outlet from the positive displacement pump;

a first collapsible container for containing liquid cleanser, the first collapsible container having an outlet;

a second collapsible container for containing liquid cleanser, the second collapsible container having an outlet, wherein the first collapsible bag is located in a position above the second collapsible bag;

at least one connecting tube for connecting in fluid communication the outlet of the first collapsible bag with the outlet of the second collapsible bag; and a supply line for coupling in fluid communication the first collapsible container and the second collapsible container to the inlet of each of the plurality of dispensers, the supply line having a first end and a plurality of second ends, the first end coupled in fluid communication with the at least one connecting tube at a location above a bottom of the second collapsible container, and the plurality of second ends connected in fluid communication to the inlets of the positive displacement pumps to permit the flow of liquid cleanser first from the first collapsible container and then from the second collapsible container under the vacuum caused by the positive displacement pumps.

* * * * *